United States Patent [19]

Huber et al.

[11] 4,222,712

[45] Sep. 16, 1980

[54] MULTIPLE DISPLACEMENT PUMP SYSTEM WITH BYPASS CONTROLLED BY INLET PRESSURE

[75] Inventors: Melvin F. Huber; Lowell D. Hansen, both of Rockford, Ill.

[73] Assignee: Sundstrand Corporation, Rockford, Ill.

[21] Appl. No.: 878,010

[22] Filed: Feb. 15, 1978

Related U.S. Application Data

[62] Division of Ser. No. 666,774, Mar. 15, 1976, Pat. No. 4,102,606, which is a division of Ser. No. 470,988, May 17, 1974, Pat. No. 3,953,153.

[51] Int. Cl.[2] ..... F04B 23/10; F04B 49/00

[52] U.S. Cl. ..... 417/204; 417/286; 417/309; 417/310

[58] Field of Search ..... 417/62, 204, 286–288, 417/302, 303, 309, 310, 426, 428

[56] References Cited

U.S. PATENT DOCUMENTS

| | | | |
|---|---|---|---|
| 2,377,556 | 6/1945 | Jeannin | 417/62 |
| 2,683,418 | 7/1954 | Smith, Jr. | 417/309 |
| 3,081,706 | 3/1963 | Drutchas et al. | 417/204 |
| 3,182,596 | 5/1965 | Prijatel | 417/309 |

*Primary Examiner*—John J. Vrablik

*Attorney, Agent, or Firm*—Wegner, Stellman, McCord, Wiles & Wood

[57] ABSTRACT

A multiple displacement pump system and method utilizing a single fixed displacement pump having pumping elements providing both first and second sets of pumping chambers. Circuit means having a fluid utilization conduit provides for delivery of fluid to said fluid utilization conduit which is either the sum of fluid delivered from both sets of pumping chambers or from only one set of pumping chambers. Additionally, the circuit means includes various alternate forms of control dependent upon pressure in a part of the system or on speed of a mechanism utilizing the pumped fluid to establish conditions wherein fluid delivered by the system is at either a desired flow rate or within a range of flow rates at different pressures.

5 Claims, 8 Drawing Figures

MULTIPLE DISPLACEMENT PUMP SYSTEM WITH BYPASS CONTROLLED BY INLET PRESSURE

CROSS-REFERENCE TO RELATED APPLICATIONS

This application is a division of application Ser. No. 666,774, filed Mar. 15, 1976, now U.S. Pat. No. 4,102,606 with said prior application being a division of application Ser. No. 470,988, filed May 17, 1974, which is now U.S. Pat. No. 3,953,153, issued Apr. 27, 1976.

BACKGROUND OF THE INVENTION

This invention pertains to a multiple displacement pump system and, more particularly, a system having a fixed displacement vane-type pump having a first set of pumping chambers between the vanes and a second set of pumping chambers beneath the vanes with circuit means to deliver fluid to a downstream fluid utilization conduit which may be either the sum of fluid delivered from both sets of pumping chambers or fluid from only one set of pumping chambers, with return of the non-utilized fluid to one of said sets of pumping chambers.

The prior art includes disclosures of pumps with pumping elements which have two sets of pumping chambers defined by spaces between the pumping elements and spaces beneath the pumping elements. This prior art includes Finlayson et al U.S. Pat. No. 2,511,573, Vickers U.S. Pat. No. 2,570,411, and Lock U.S. Pat. No. 3,639,089. These patents do not have any disclosure of either fluid inlet means or fluid outlet means with separate conduits providing for selective volumes of flow of fluid from the pump, dependent upon flow in one of the separate conduits being cross-connected to the other side of the fluid path whereby the cross-connected flow does not reach a fluid utilization conduit downstream of the control.

Additional prior art patents disclose pumps having first and second sets of pumping chambers, with separate conduits for flow from the respective sets of pumping chambers. This prior art includes Links U.S. Pat. No. 2,688,924, Poulin U.S. Pat. No. 3,043,234, and Bellmer U.S. Pat. No. 3,565,550. These prior art patents do not show circuit means associated with the fluid inlet and outlet means for the pump providing for suitable cross-connection therebetween whereby fluid may be delivered to a fluid utilization conduit and which is either the sum of fluid delivered from both sets of pumping chambers or from only one set of pumping chambers.

The prior art has also recognized the concept of taking two outlet flows from a pump, as shown in Adams et al U.S. Pat. No. 2,832,199 and Brundage U.S. Pat. No. 3,128,707; however, these two fluid outlet paths are not provided by outlets from two distinct sets of pumping chambers arranged between and beneath the pumping elements, respectively.

SUMMARY

A primary feature of the invention as disclosed herein resides in utilization of a fixed displacement pump having two sets of pumping chambers arranged respectively between pumping elements and under the same pumping elements along with a control whereby multiple displacements from the pump may be selected as if the pump were a variable displacement pump.

In the control of the pump, the circuit associated therewith may include desired valve components for having the output flow to a fluid utilization conduit be either the sum of fluid delivered from both sets of pumping chambers or from only one set of pumping chambers. Also, the control may be responsive to pressures existing in either the fluid utilization conduit or in the fluid inlet means of the pump. Also, a speed control capability may be provided with the total flow being subject to control by the speed of a mechanism receiving the pumped fluid.

In the invention disclosed herein, the pump has two sets of pumping chambers, with fluid inlet means and fluid outlet means connected thereto and with at least one of the last two mentioned means having separate conduits connected to said first and second sets of pumping chambers, respectively, whereby one of said separate conduits may be cross-connected to the other of said fluid inlet and fluid outlet means whereby flow through said cross-connection is not delivered to the fluid utilization conduit.

In one embodiment of the invention, the circuit has a spool valve arranged with the pump to provide three distinct pump displacements with two of said displacements being a flow from one or the other of said set of pumping chambers and the third flow being the sum of the flow from both sets of pumping chambers.

In another embodiment, the pump may operate as a maximum displacement pump up to a certain pressure value in the fluid utilization conduit, with only flow from one set of pumping chambers delivered above said pressure until a certain higher predetermined pressure is reached and above the latter pressure the pump again changes to a maximum displacement device delivering flow from both sets of pumping chambers. A typical application of this mode of operation could be the supply of fuel to a jet engine turbine operating at a high turndown or bypass conditions to minimize the fuel system heat load by changing to, in effect, a smaller displacement pump and bypassing the remaining total flow back to the pump in the intermediate pressure range.

In still another embodiment of the invention for use on a gas turbine engine, for example, the total displacement from both sets of pumping chambers provides for a large flow at start-up of the pump and windmill operation with a change to a lesser flow for normal engine operation. In the illustrated embodiment, fluid delivered to the pump is supplied by a boost pump and a signal is taken from a pressure rise in the inlet pressure to cause the circuit to change flow displacement to the fluid utilization conduit.

In another embodiment of the invention, the circuit associated with the pump provides for full flow capability from both sets of pumping chambers during maximum flow demand operations and with variable flow conditions automatically established when a speed of the mechanism receiving the fluid pumped exceeds a predetermined value.

DESCRIPTION OF THE PREFERRED EMBODIMENTS

Figure 1:
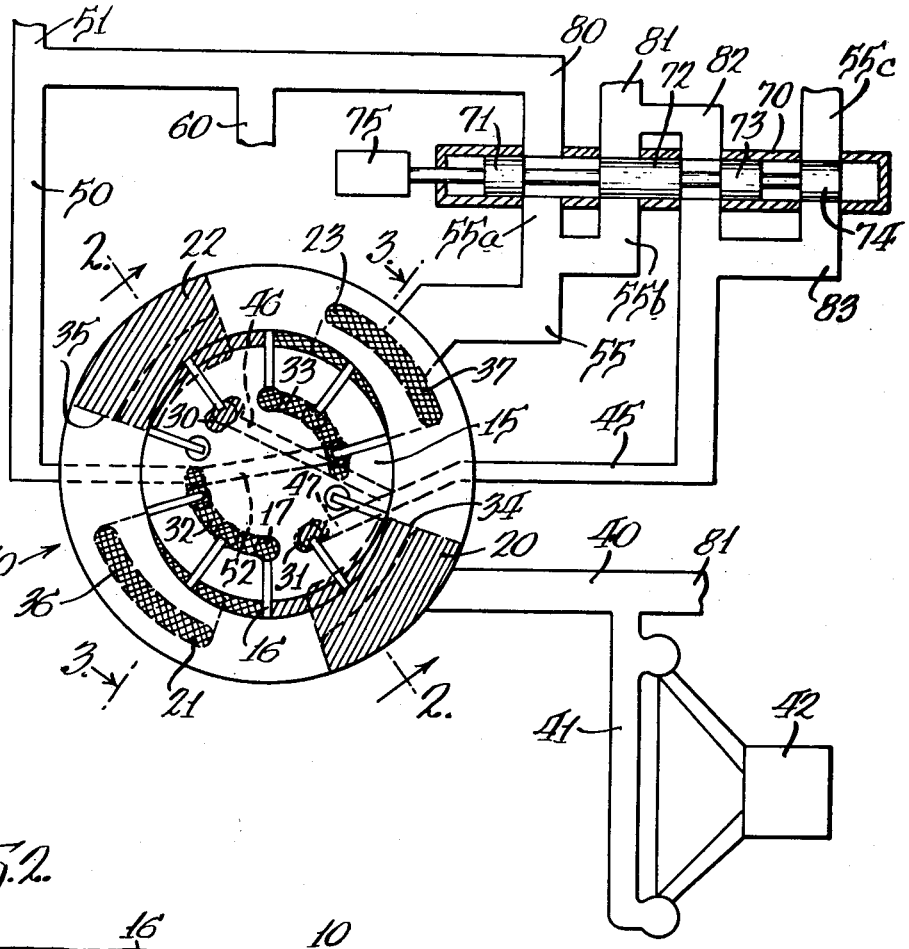
FIG. 1 is a schematic view of a balanced multilobe, fixed displacement vane-type pump having circuit means associated therewith providing selectively for effectively different flow displacements from the pump.
Figure 2:
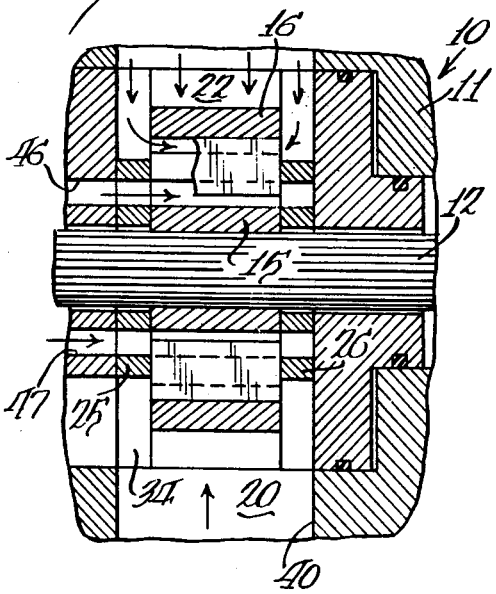
FIG. 2 is a transverse section of the pump shown in FIG. 1 and taken generally along the line 2—2 in FIG. 1.
Figure 3:
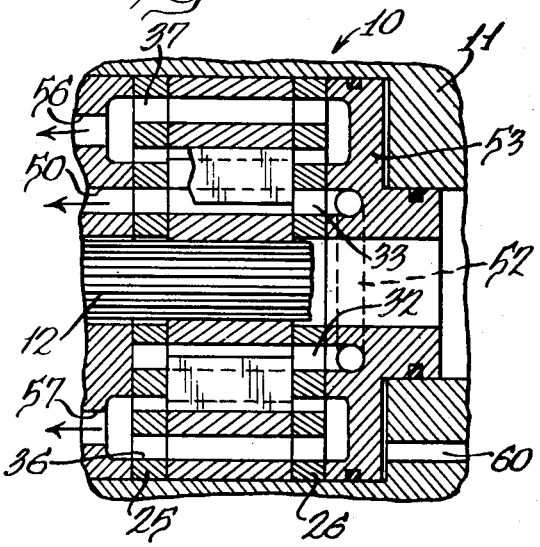
FIG. 3 is a transverse section, taken generally along the line 3—3 in FIG. 1.

In the embodiment of FIGS. 1 to 3, a fixed displacement, double lobe, vane-type pump is shown in association with a control circuit for providing three different flow rates from the pump. The pump, indicated generally at 10, has a case 11 mounting a drive shaft 12 carrying a rotor 15 which rotates within a ring 16 having a pair of lobes to provide a balanced pump with two pumping sections.

The rotor 15 carries a series of pumping elements, in the form of vanes 16, movable mounted in slots in the rotor for movement generally radially of the axis of rotation of the rotor. The vanes 16 provide a first set of pumping chambers by the swept volume defined by the space between vanes and a second set of pumping chambers at the inner ends of the rotor slots mounting the vanes and which are enlarged as shown at 17. As shown in FIG. 1, the rotor 15 rotates in a clockwise direction to successively carry the vanes 16 through a first pumping path between an inlet area 20 and an outlet area 21 while others of said vanes are travelling from an inlet area 22 to an outlet area 23.

A pair of port plates 25 and 26 are provided with four distinct ports with the ports for one of the port plates being shown in FIG. 1 and including a pair of relatively short inlet ports 30 and 31 for the underside of the vanes 16 and a relatively long pair of outlet ports 32 and 33 for the underside of the vanes 16. Additionally, the port plates each have peripherally notched sections 34 and 35 in the inlet area communicating with the swept vane area and a pair of elongate ports 36 and 37 coacting with the swept vane area in the discharge areas 21 and 23, respectively, of the pump.

Fluid inlet means for the pump includes a conduit 40 supplied by a boost pump 41 connected to a source 42 of fluid, such as oil or fuel for an engine, with the conduit 40 communicating with the inlet area 20 for supplying the swept area between the vanes 16 in such area and with this area being shown shaded in FIG. 1. By suitable passages (not shown) in the pump case 11, the conduit 40 also supplies inlet fluid to the opposite inlet area 22.

The fluid inlet means includes a second separate conduit 45 which, through branch conduits 46 and 47, supplies the ports 30 and 31, respectively, in the inlet area communicating with the rotor slots beneath the vanes 16.

Fluid outlet means from the pump includes a first conduit 50 connected to a fluid utilization conduit 51 for delivering fluid to a mechanism which receives the pumped fluid. This conduit 50 receives flow from the second set of pumping chambers beneath the vanes 16 and flowing through the ports 32 and 33 in the discharge areas 21 and 23, with the ports 32 and 33 being interconnected by a passage 52, shown diagrammatically in FIG. 1. This passage 52, as shown in FIG. 3, is formed in a pressure loading piston 53 which functions to exert compressive forces on the port plates and hold them in operative association with the rotor 15 of the pump.

The fluid outlet means includes a second conduit 55 which receives flow from passages 56 and 57 in the pump casing delivered from the discharge areas 21 and 23 and combines the discharge flow from the swept areas of the pump in the two discharge areas.

The pressure loading piston 53 is urged to the left, as viewed in FIGS. 2 and 3, by pressure of fluid exerted through a passage 60 which is in communication with the discharge conduit 50, as shown in FIG. 1.

With the pump as described, there are two sets of pumping chambers disposed between and beneath the vanes, respectively, with each set of pumping chambers having an inlet conduit and a separate outlet conduit. The inward and outward movement of the vanes 16 as caused by the cam contour of the ring 16 causes the pumping action in the second set of pumping chambers.

The control circuit, shown in FIG. 1, provides for flow to the fluid utilization conduit 51 which is either the sum of fluid delivered from both sets of pumping chambers or from either one of the two sets of pumping chambers.

The control circuit includes a control valve 70 having a movable control valve member in the form of a spool having lands 71, 72, 73, and 74. The valve spool is positionable by a control element 75, such as a solenoid or other device, which responds to a control signal to position the valve spool. The valve spool is shown in FIG. 1 positioned for maximum flow from the pump. The discharge conduit 55 has three connections into the casing of the control valve, as indicated at 55*a*, 55*b*, and 55*c*. A line 80 extends from the control valve 70 to the fluid utilization conduit 51 and has the branch line 60 leading to the pressure loading piston 53. A line 81 extends from the conduit 40 leading from the boost pump 41 and has a branch 82 also extending to the control valve 70. The inlet conduit 45 extends to the control valve 70 with a branch 83 also extending to the control valve.

With the control valve member positioned as shown in FIG. 1, the discharge conduit 55 connects through the control valve to the line 80 leading to the fluid utilization conduit 51. At the same time, fluid from the boost pump, delivered through line 81, passes through branch line 82 and the control valve to the inlet conduit 45 for supply of the under vane pumping chambers. Branch conduit 55*c* from the discharge conduit 55 is blocked by the land 74 of the valve. The boost pump 41 supplies both sets of pumping chambers and total flow is delivered from the pump.

When the control valve member is shifted to the left, from the position of FIG. 1, flow through the discharge conduit 55 can still flow to line 80 leading to the fluid utilization conduit 51. Flow from the boost pump, delivered to the control valve by line 81, cannot reach the inlet conduit 45 because the land 73 is blocking the branch line 82, while the land 72 is blocking the line 81. The land 74 has moved out of blocking relation with the branch conduit 55*c* whereby flow from the discharge conduit 55 flows to a line 83 supplying the inlet conduit 45 for the under vane pumping chambers. The total flow from the pump is reduced by the amount of fluid delivered to the under vane pumping chambers.

A third flow condition is established by shift of the valve spool to the right from the position shown in FIG. 1, wherein land 71 blocks the discharge conduit 55 communicating with line 80 and with land 72 shifted to the right to connect branch conduit 55*b* with the line 81 branching from the inlet conduit 40 whereby discharge from the first set of pumping chambers between vanes is delivered to the inlet for the same set of pumping chambers. Additionally branch conduit 55*c* connects with line 83 leading to the inlet conduit 45 for the under vane pumping chambers. In this condition, effective output is the fluid pumped by the second set of pumping chambers.

Normally, total flow from the first set of pumping chambers between vanes is substantially larger than the flow from the second set of pumping chambers beneath the vanes whereby there are three different rates of flow from the pump, depending upon the position of the control valve. For maximum flow both sets of pumping chambers are supplied from the boost pump 41, with the supply to the inlet conduit 45 being from the branch line 82 which is supplied by the boost pump.

Figure 4:
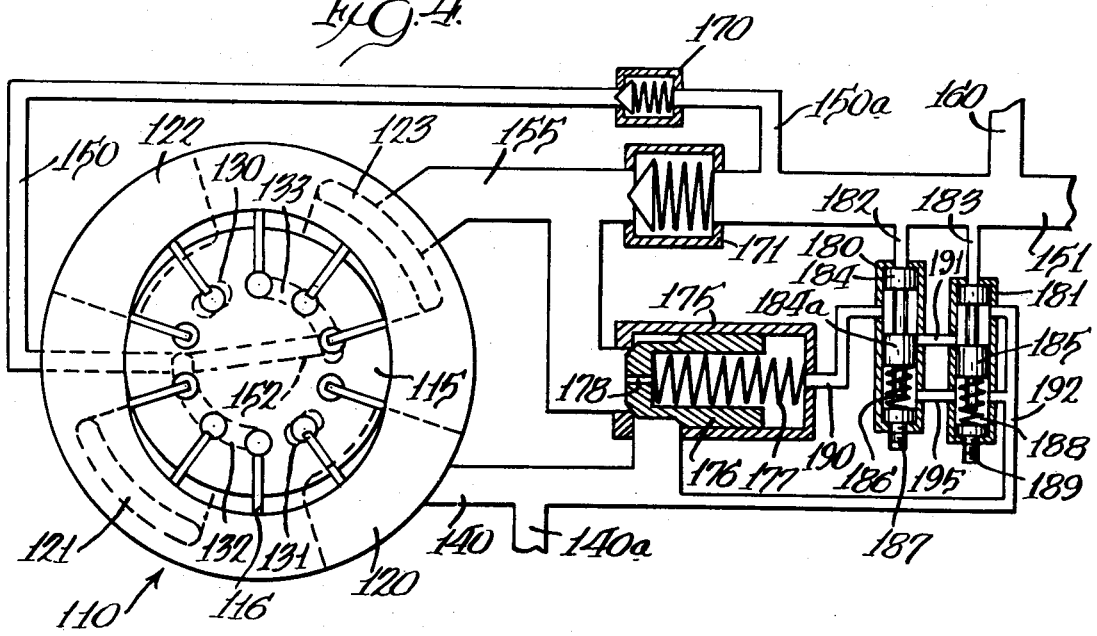
FIG. 4 is a schematic view of a second embodiment of the invention, with a pump constructed slightly differently from the pump of FIG. 1 and with a different control circuit associated therewith.

An alternate embodiment is shown in FIG. 4 wherein a pump, indicated generally at 110, is of basically the same construction as the pump 10 in the embodiment of FIGS. 1 to 3 with fluid inlet areas 120 and 122 and fluid outlet areas 121 and 123. A plurality of vanes 116 are carried past the inlet and outlet areas by a rotor 115 and with a first set of pumping chambers being the swept volume between the vanes 116 and a second set of pumping chambers being defined by the rotor slots beneath the vanes. The fluid inlet areas 120 and 122 are supplied with fluid from a conduit 140 connected to an inlet line 140*a*. In this embodiment of the pump, the inner inlet ports 130 and 131 are supplied from the inlet areas 120 and 122 by passages in the pump case (not shown) so that there is a common supply of fluid to both the first and second sets of pumping chambers. A discharge conduit 150 receives pumped fluid from the second set of pumping chambers delivered through ports 132 and 133 and including a connecting passage 152. Fluid discharged from the first set of pumping chambers is directed to a discharge conduit 155.

In this embodiment, the circuit means are associated with the pump to provide for delivery of full pump flow to a fluid utilization conduit 151 when the outlet fluid pressure is beneath a certain valve or above a higher value and with only partial flow when the discharge pressure is between the aforesaid two values. A conduit 160 branches from the conduit 151 for delivery of pressure fluid to the pressure loading piston of the pump.

The circuit means includes a pair of check valves 170 and 171, positioned in the discharge conduits 150 and 155, respectively, to prevent reverse flow of fluid toward the pump. A normally closed unloading valve 175 has a valve member 176 urged to a closed position by a spring 177 and with an orifice passage 178 permitting restricted flow from the discharge conduit 155 to the right-hand end of the unloading valve 175. The valve member 176, when closed, blocks communication between the discharge conduit 155 and the inlet conduit 140 leading to the pump 110.

A pair of pressure-responsive valves 180 and 181 each have an inlet line connection 182 and 183, respectively, to the fluid utilization conduit 151 for directing pressure in the latter conduit against the respective valve spools 184 and 185. The valve 180 has a spring 186 adjustable by a member 187 for setting the value of a pressure above which the valve spool 184 will be shifted from the position shown in FIG. 4. A similar spring 188 and adjusting member 189 are associated with the valve spool 185 for setting a pressure at which the valve spool 184 will shift downwardly from the position shown in FIG. 4.

In one example of control provided by the circuit means of FIG. 4, spring 186 can be set for shifting of the pressure-responsive valve 180 at a pressure of 300 psi in the conduit 151 and the valve 181 set for shift when the pressure in the conduit 151 reaches 600 psi. With pressures up to 300 psi, a line 190 extending from the unloading valve 175 to the pressure-responsive valve 180 is blocked by valve land 184*a*, with the resultant balancing of pressures at both sides of the unloading valve member 176 whereby the spring 177 maintains the unloading valve in closed position. With the unloading valve closed, the flow from both sets of pumping chambers is delivered through the check valves 170 and 171 to the fluid utilization conduit 151. When the discharge pressure reaches 300 psi, the valve member 184 shifts downwardly, wherein the line 190 leading from the unloading valve connects to a line 191 extending between the pressure-responsive valves and which communicates with a line 192 leading to the inlet conduit 140 when the pressure-responsive valve member 185 is in its upper position, shown in FIG. 4. This permits flow of fluid to inlet conduit 140 from the right-hand end of the unloading valve whereby pressure in discharge conduit 155 acts to open the unloading valve and to connect discharge conduit 155 to inlet conduit 140. As a result, the flow to the fluid utilization conduit 151 is only the flow from the second set of pumping chambers beneath the vanes 116 and which is directed to the discharge 150. This flow cannot reach the discharge conduit 155 because of the check valve 171 positioned between the pump 110 and a section 150*a* of the discharge conduit 150 which connects into the fluid utilization conduit 151.

As pressure in the fluid utilization conduit reaches 600 psi, the valve member 185 also shifts downwardly, whereby the upper land thereof blocks communication between the line 191 and the line 192. Fluid pressure builds up in the right-hand end of the unloading valve 175 and the unloading valve member 176 returns to the closed position, shown in FIG. 4. Flow from both sets of pumping chambers is delivered to the fluid utilization conduit. A line 195 connects the spring chambers of the two pressure-responsive valves to the line 192 to direct leakage flow back to the inlet conduit 140.

In this embodiment, upon start up of the pump, total flow can be delivered and up to a certain discharge pressure, such as 300 psi. In a system supplying fuel to an engine and when the engine is idling or the aircraft having the engine is in descent posture, the flow from the second set of pumping chambers only is required and at a pressure between the settings of the two pressure-responsive valves. Above a certain pressure, the fluid is supplied from both sets of pumping chambers for use by a receiving mechanism, such as an aircraft engine.

Figure 5:
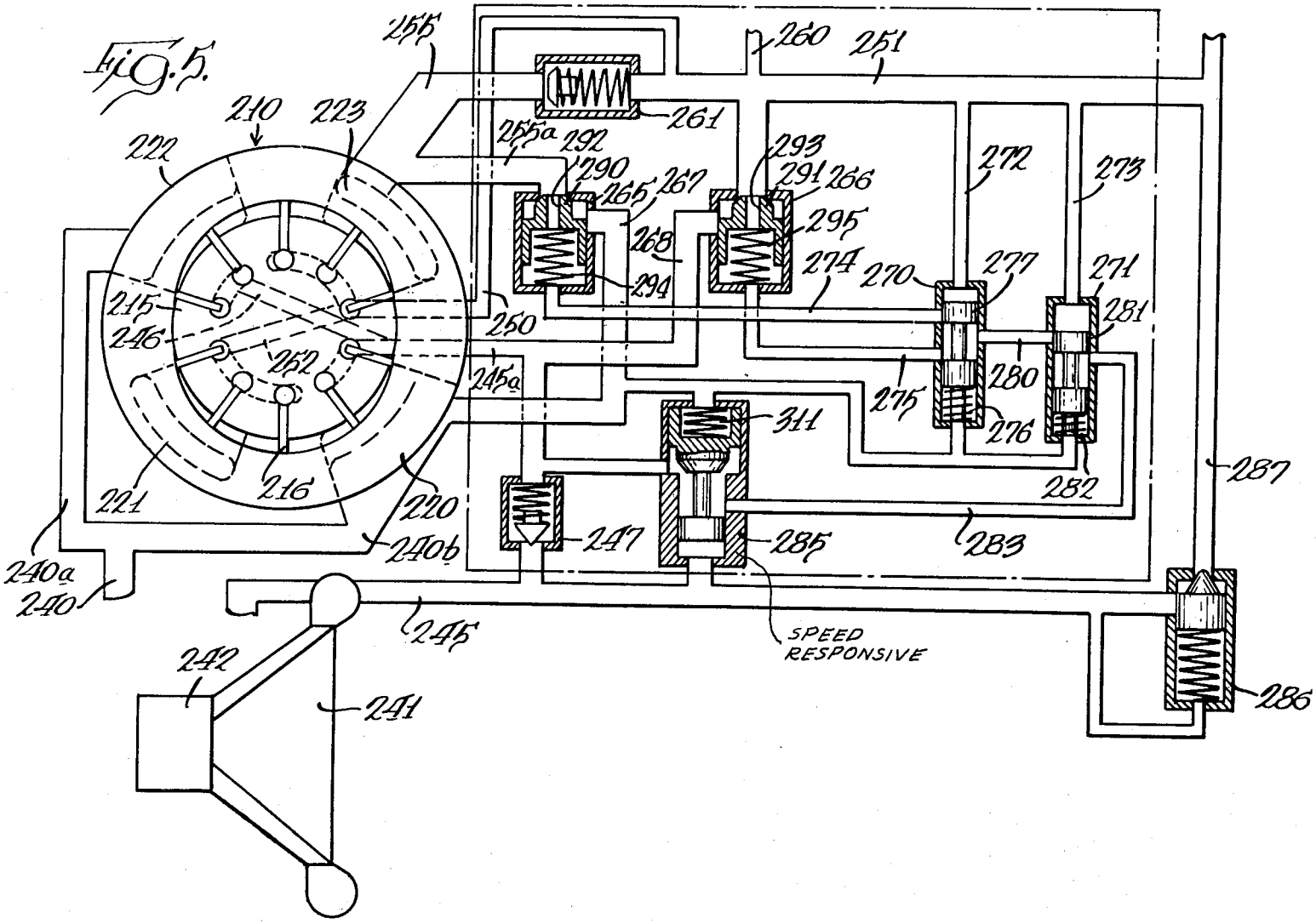
FIG. 5 is a schematic view of a modified version of the pump, with a control circuit associated therewith to provide for different flow displacements at different speeds of operation of a mechanism receiving flow from the pump and with multiple flow displacement values when the delivered fluid is at various selected pressure values.
Figure 6:
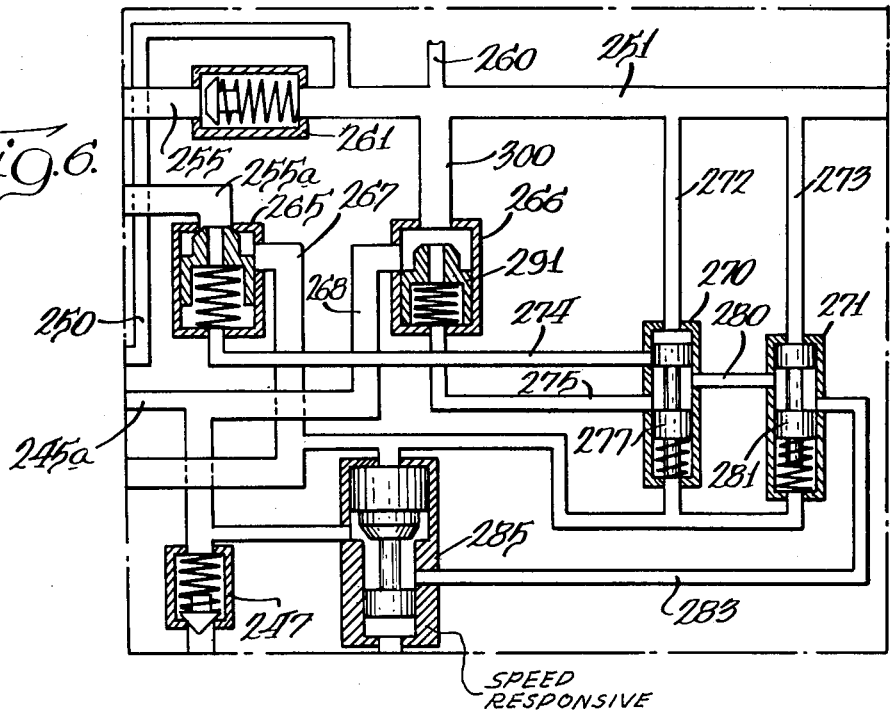
FIG. 6 is a view, similar to FIG. 5, with the pump omitted and showing the control circuit associated therewith in a different operative position.
Figure 7:
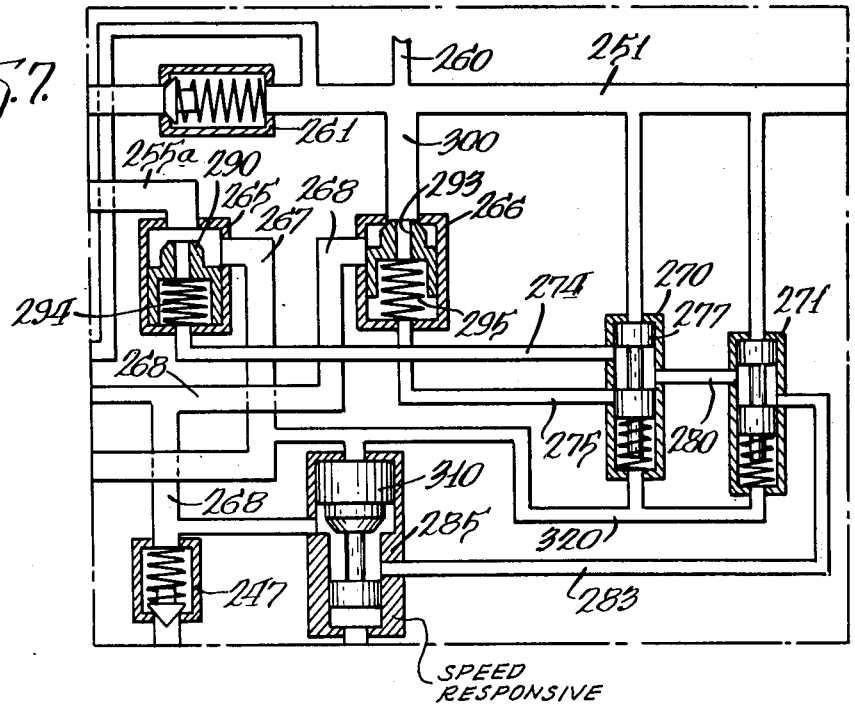
FIG. 7 is a view, similar to FIG. 6, showing the control circuit thereof in a different operative position.

A third embodiment of the invention is shown in FIGS. 5 to 7 wherein the control associated with the multidisplacement pump provides for maximum flow delivered from both sets of pumping chambers up to a certain predetermined speed of the mechanism receiving the flow and with three different flow capabilities above said predetermined speed and variably, depending upon the pump discharge pressure.

A specific example of utilization of this embodiment would be for a main engine fuel pump for an aircraft where the flow demand at take-off may be 100 to 150 times the flow demand during an in-flight descent.

FIG. 5 has a pump of the same configuration as the pump shown in FIG. 1. The pump 210 has a rotor 215 carrying a plurality of vanes 216 for travel successively between inlet areas 220 and 222 and outlet areas 221 and 223. An inlet conduit 240 has branches 240*a* and 240*b* connected to the respective inlet areas 220 and 222 for delivering fluid thereto. The inlet conduit 240 is supplied from a boost pump 241 connected to a reservoir 242 which also delivers fluid under pressure to an inlet conduit 245. The left-hand end of the inlet conduit 245 connects through a fuel heater and filter (not shown) to the inlet conduit 240 for supplying the first set of pumping chambers between the vanes 216. The inlet conduit 245 has a branch 245*a* connecting to the inlet ports for the second set of pumping chambers beneath the vanes 216 including a passage 246 in the pump case. A check valve 247 is in the flow path to the inlet ports providing for unidirectional flow to the ports.

A discharge conduit 250 receives fluid under pressure from the second set of pumping chambers beneath the vanes, including flow from the connecting passage 252 and connects into a fluid utilization conduit 251. A discharge conduit 255 receives fluid discharged from the first set of pumping chambers between the vanes and has a branch conduit 255*a*. The fluid utilization conduit 251 has a branch line 260 which extends to the pressure loading piston (not shown) for the pump and corresponding to the piston 53 of the embodiment of FIGS. 1 to 3.

The control circuit in the embodiment of FIGS. 5 to 7 includes a plurality of valves and with several of the operative positions thereof being shown in FIGS. 5 to 7. FIG. 5 shows the valves positioned to provide full flow from the pump when the engine or other mechanism receiving the fluid, such as fuel, is operating above a predetermined speed. The control includes a check valve 261 between the discharge conduit 255 and the fluid utilization conduit 251 to prevent reverse flow to the pump from either the discharge conduit 250 or the fluid utilization conduit 251.

A pair of unloading valves 256 and 266 have outlets connected to the inlets for the respective sets of pumping chambers, whereby, when an unloading valve is opened, flow passes therethrough back to the associated pump inlet area. The unloading valve 265 has a line 267 extending to the inlet branch conduit 240*b* for the first set of pumping chambers between the vanes 216. The unloading valve 266 has a line 268 connecting into the inlet branch conduit 245*a* downstream of the check valve 247 whereby when the latter unloading valve is opened flow therethrough passes to the inlet area for the second set of pumping chambers beneath the vanes. The control of the unloading valves 265 and 266 is effected by a pair of pressure-responsive valves 270 and 271 which are subject to pressure in the fluid utilization conduit 251 through a pair of connecting lines 272 and 273. A pair of lines 274 and 275 extend from the respective unloading valves 265 and 266 to the pressure-responsive valve 270. A spring 276 in the pressure-responsive valve 270 determines the pressure at which the valve member 277 will shift from a normal upper position, shown in FIG. 7. This valve member controls the connection of either of lines 274 or 275 leading from the unloading valves to a line 280 extending to the second pressure-responsive valve 271. The pressure-responsive valve 271 has a valve spool 281 normally urged upwardly by a spring 282 and with this valve member being positionable to either block communication between line 280 and a line 283 or permit communication therebetween. The line 283 extends from the pressure-responsive valve 271 to a control valve 285 positionable in either the upper position, shown in FIG. 5, or a lowered position, dependent upon speed of the engine receiving the fuel delivered by the pump.

A relief valve 286 is connected into a branch conduit 287 of the fluid utilization conduit 251 for setting a maximum pressure for the pumped fluid and with this valve member normally being closed but, upon an excess pressure condition, opening to connect the branch conduit 287 to the inlet conduit 245.

In the high pressure, high speed operation provided by the circuit, as shown in FIG. 5, flow from both sets of pumping chambers is delivered to the fluid utilization conduit 251 and with total fluid supplied to the pump being delivered through the inlet conduit 245. This condition occurs because both of the pressure-responsive valves 270 and 271 have their valve spools in lowered position whereby a land of valve spool 281 blocks the line 280 from communicating with line 283. In this condition, lines 274 and 275 leading from the unloading valves 265 and 266 are blocked, whereby fluid at the same pressure exists at both sides of the unloading valve members 290 and 291 by means of the restricted flow passages 292 and 293, respectively. The springs 294 and 295 positioned, one in each unloading valve, assure that the unloading valves are maintained in closed position.

The speed responsive valve 285 is in open position to connect the line 283 with the inlet branch conduit 245*a*; however, this part of the circuit is not active since the pressure-responsive valve 271 is in its lowered position.

FIG. 6 shows the control circuit of FIG. 5 with a slight modification in the positioning of components thereof to effect displacement from the pump 210 equal to flow pumped by the first set of pumping chambers between vanes. In effect, the inlet flow to the second set of pumping chambers beneath the vanes is supplied from the fluid utilization conduit 251. This flow condition is established by a pressure condition in conduit 251 which is at a value beneath that occurring in the condition of the circuit shown in FIG. 5 and which results in an upward shift of the valve spool 281 of the pressure-responsive valve 271. The upward shift of the valve spool 281 places line 280 in communication with line 283 whereby fluid can flow to pump inlet from line 275 which connects into the unloading valve 266. The discharge pressure in fluid utilization conduit 251 is applied to the valve member 291 of the unloading valve through a branch conduit 300 and the imbalance of pressure results in lowering the valve member 291 whereby the branch conduit 300 is connected to the line 268 which supplies the second set of pumping chambers beneath the vanes 216. In this condition, the check valve 247 is closed, as shown in FIG. 6. The supply of fluid from outlet to the second set of pumping chambers results in providing a medium range of discharge flow to the mechanism utilizing the fluid.

With a further decrease of pressure in the fluid utilization conduit 251, below a preset value, the valve member 277 of the pressure-responsive valve 270 also shifts upwardly, as seen in FIG. 7, to reverse the connections of lines 274 and 275 from the unloading valves to the line 280 which extends to pump inlet through line 283. This shift blocks line 275 whereby fluid delivered through branch conduit 300 to the unloading valve 266 passes through the orifice 293 and with a balance in pressures at both sides of the valve member the valve member moves to the closed position, shown in FIG. 7. This blocks conduit 268 so that fluid is not delivered from the fluid utilization conduit to the inlet of the second set of pumping chambers. The line 274 extending to the pressure-responsive valve 270 is open to pump inlet whereby the valve member 290 of unloading valve 265 may move downwardly against the spring 294 to the postion shown in FIG. 7 wherein the branch conduit 255*a* leading from the first set of pumping chambers is placed in communication with the conduit 267 leading to the inlet areas 220 and 222 for the first sets of pumping chambers. This causes an effective flow from the fluid utilization conduit 251 which is only the flow delivered from the second set of pumping chambers beneath the vanes since the flow derived from the first set of pumping chambers is directly returned to the inlet for the latter set of pumping chambers. In this operation, the check valve 261 is closed because of a higher pressure existing to the right thereof and the check valve 247 is also closed because of a greater pressure existing downstream thereof. With the circuit components operating as shown in FIG. 7, there is a minimum flow from the pump, as provided by the second set of pumping chambers beneath the vanes.

In the circuit condition of FIG. 7, the first set of pumping chambers is supplied with fluid delivered through the unloading valve 265. Additionally, the check valve 247 is closed and fluid from the first set of pumping chambers is supplied to the inlet conduit 268 for the second set of pumping chambers through line 274 leading from the unloading valve 265, line 280, and line 283, which is in communication with conduit 268. Any additional fluid that may be required for the pump will be delivered thereto through the inlet conduit 240 to the first set of pumping chambers.

A fourth condition results from operation of the speed responsive valve 285 having a valve member 310 which, in FIGS. 5, 6 and 7, is shown in its uppermost position and acting against a spring 311. When the speed of the mechanism using the fluid, such as a jet engine, is below a preset value, as for example 5,000 rpm, the valve 285 through mechanism (not shown) is operated to lower the spool 310 and block the line 283 from communication with the inlet branch conduit 245*a*. Blocking of line 283 thus overrides the pressure-responsive valves 270 and 271 and, in effect, blocks lines 274 and 275 leading from the unloading valves 265 and 266, respectively. The unloading valves are then positioned, as shown in FIG. 5, to provide maximum output flow from the pump to the displacement conduit 251 and without any variation in flow dependent upon discharge pressure since the pressure-responsive valves 270 and 271 are blocked against operation.

A line 320 connects with an end of each of the pressure-responsive valves 270 and 271 for receiving fluid leakage past the valve spool. This line connects with the line 267 for delivery of fluid to the inlet for the first set of pumping chambers.

Figure 8:
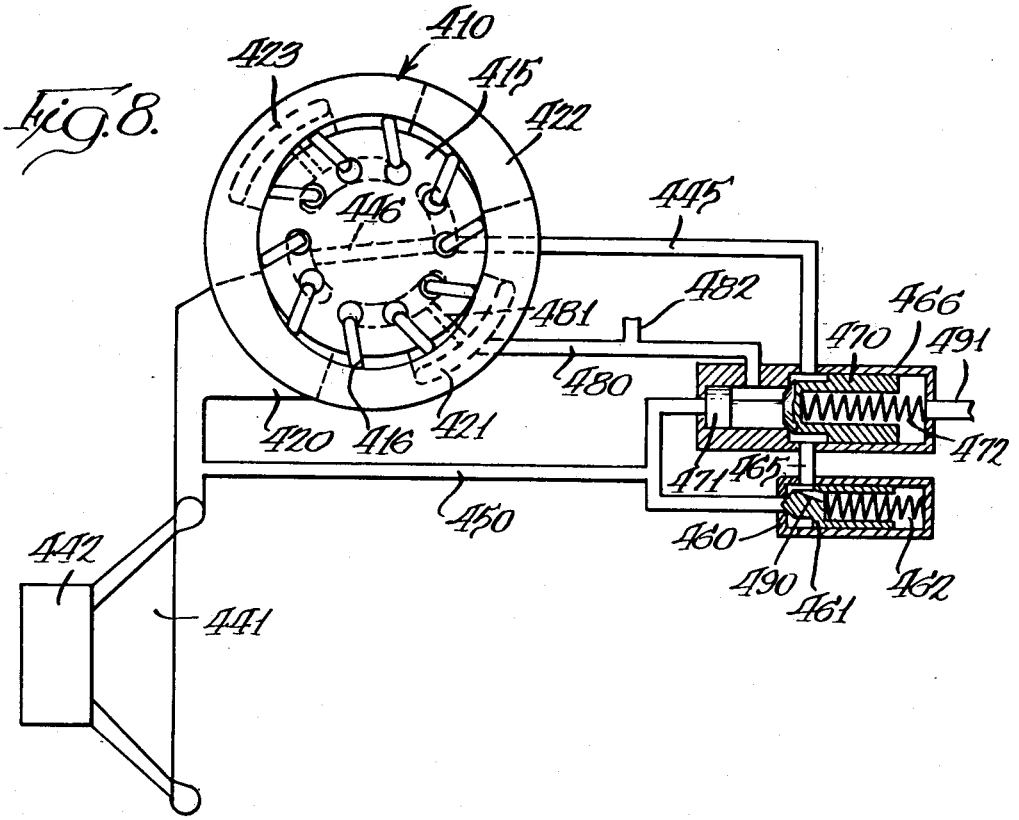
FIG. 8 is a schematic view of a modified form of the pump shown in association with a control circuit for providing modification in pump displacement dependent upon the pressure of fluid delivered to the fluid inlet means of the pump.

A fourth embodiment of the invention is shown in FIG. 8 wherein a pump 410 has inlet areas 420 and 422 positioned between outlet areas 421 and 423. In this embodiment, a rotor 415 carries a plurality of movable vanes 416. In the first three embodiments, the vanes of the pump have been shown as having a relatively thin structure and positioned for movement along paths generally radially of the axis of rotation of the rotor. In the embodiment of FIG. 8, the vanes are shown as being of a thicker construction and movable in and out with respect to the rotor along paths which are at a substantial angle to radial lines. This variation in the pump of FIG. 8 illustrates a manner in which the relative flow rates between the first and second sets of pumping chambers may be varied. Thicker vanes require bigger slots in the rotor and, therefore, the second set of pumping chambers beneath the vanes is bigger and increased proportionately to the space between the vanes. Additionally, changes in the angular relation of the vanes in a particular pump result in a different volume of pumped fluid between each pair of vanes.

In FIG. 8, a branch conduit 450 extends from the inlet conduit which is supplied with inlet fluid from a boost pump 441 supplied with fluid from a reservoir 442.

The second set of pumping chambers beneath the vanes 416 are supplied with fluid through an inlet conduit 445 and a branch 446 corresponding to branch 46 of the embodiment of FIG. 1. The inlet conduit 445 communicates with the branch conduit 450 through valves of the control circuit of this embodiment. The communication is controlled by a check valve 460 having a valve member 461 urged to a closed position by a relatively weak spring 462. The spring force is sufficiently small whereby the pressure of inlet fluid supplied by the boost pump 441 is adequate to open the check valve to have fluid flow through a connecting line 465 which connects to a selector valve 466 which directly communicates with the inlet conduit 445.

In this embodiment, the selector valve 466 is responsive to the discharge pressure of the boost pump 441. The selector valve has a valve spool 470, with a piston 471 subjected to the boost pressure in branch conduit 450. When the boost pressure is below a predetermined value, as set by a spring 472, the valve member 470 is positioned as shown in FIG. 8 wherein a conduit 480 is blocked at the selector valve 466. The conduit 480 connects to the fluid outlet areas 421 and 423 of the pump 410 and receives the combined discharge flow from both sets of pumping chambers with the ports of the second set of pumping chambers beneath the vanes being connected to the first set of pumping chambers by passages in the pump case indicated diagrammatically at 481. Thus, total flow from the pump is through conduit 480 to a fluid utilization conduit 482. During this operation, the boost pump 441 is supplying both sets of pumping chambers through the inlet conduit 420 and the inlet conduit 445.

When the boost pressure rises above the preset value, this pressure acts on the piston 471 to shift the valve member 470 to the right, as viewed in FIG. 8. This opens the selector valve whereby fluid can flow from the conduit 480 through the selector valve to the inlet conduit 445 which supplies the second set of pumping chambers beneath the vanes. At the same time, this fluid at pump outlet pressure passes through line 465 to the check valve 460 and places the right-hand end of the check valve under pressure by communication through an orifice passage 490 in the check valve whereby the check valve closes to block the branch inlet conduit 450 from communication with the inlet conduit 445 leading to the second set of pumping chambers. As a result, the flow to the utilization conduit 482 is the flow delivered by the first set of pumping chambers, since the outlet flow from the second set of pumping chambers is returned back to the inlet for the latter chambers. The spring end of selector valve 466 has a tank line 491 for leakage flow.

The system disclosed in FIG. 8, as an example, can be used for controlling a pump for a gas turbine wherein total flow is used at the start and in windmill operation and when the boost pressure reaches a certain value related to the speed of the gas turbine there is a shift over to using a lesser flow which is the flow only from the first set of pumping chambers.

With the various embodiments disclosed herein, a single, fixed displacement pump is provided with capability for multiple displacements and with controls associated with the pump providing for use of maximum flow or a lesser flow and with the selection of flow being selectable either upon values of discharge pressure from the pump or boost pressure of fluid supplied to the pump as well as selectivity based upon speed of a mechanism, such as an engine, using a fluid, such as fuel, delivered by the pump.

We claim:

1. A multiple displacement pump system including a vane pump having a housing with means defining a rotor chamber having walls and a rotor carrying a plurality of vanes movable in a pumping path in said rotor chamber between fluid inlet means and fluid outlet means with a first set of pumping chambers between said vanes and the walls of said rotor chamber and a second set of pumping chambers beneath and radially inward of said vanes, port plate means having ports for connecting said fluid inlet means and said fluid outlet means to said sets of pumping chambers at timed intervals in rotation of the rotor, said fluid inlet means having two separate conduits for supplying fluid to the respective sets of pumping chambers, and circuit means connected to said pump and having a fluid utilization conduit, and means responsive to a predetermined pressure in the fluid inlet means for connecting the fluid outlet means with one of said separate conduits of the fluid inlet means.

2. A multiple displacement pump system including, a pump having a housing with means defining a chamber with walls, a plurality of pumping elements carried by a rotatable member in said chamber and movable in a pumping path between fluid inlet means and fluid outlet means with a first set of pumping chambers between said elements and walls and a second set of pumping chambers beneath and radially inward of said elements as the elements move in said path, and circuit means connected to said fluid inlet and outlet means and having a fluid utilization conduit for delivery of fluid to said conduit which is either the sum of fluid delivered from both sets of said pumping chambers or from only one set of pumping chambers, including a control valve having fluid connections to both of said fluid outlet means and fluid inlet means, said fluid inlet means having two separate conduits to the respective sets of pumping chambers, a control valve member selectively positionable to cross-connect one of said separate conduits to the fluid outlet means, and means responsive to the pressure in the fluid inlet means for controlling the position of the control valve member.

3. A multiple displacement pump system including, a pump having a housing with means defining a chamber with walls, a plurality of pumping elements carried by a rotatable member in said chamber and movable in a pumping path between fluid inlet means and fluid outlet means with a first set of pumping chambers between said elements and walls and a second set of pumping chambers beneath and radially inward of said elements as the elements move in said path, and circuit means connected to said fluid inlet and outlet means and having a fluid utilization conduit for delivery of fluid to said conduit which is either the sum of fluid delivered from both sets of said pumping chambers or from only one set of pumping chambers, including a control valve having fluid connections to both of said fluid outlet means and fluid inlet means, one of said fluid inlet means and fluid outlet means having two separate conduits to the respective sets of pumping chambers and the other having a single conduit to the respective sets of pumping chambers, a control valve member selectively positionable to cross-connect one of said separate conduits to the single conduit, means responsive to the pressure in the fluid inlet means for controlling the position of the control valve member, and means for blocking communication between the other of said separate conduits and the single conduit.

4. A multiple displacement pump system including a vane pump having a housing with means defining a rotor chamber having walls and a rotor carrying a plurality of vanes movable in a pumping path in said rotor chamber between fluid inlet means and fluid outlet means with a first set of pumping chambers between said vanes and the walls of said rotor chamber and a second set of pumping chambers beneath and radially inward of said vanes, port plate means having ports for connecting said fluid inlet means and said fluid outlet means to said sets of pumping chambers at timed intervals in rotation of the rotor, said fluid inlet means having two separate conduits for supplying fluid to the respective sets of pumping chambers, and circuit means connected to said pump and having a fluid utilization conduit, a fluid line connecting said separate conduits, a check valve in said fluid line, a selector valve in said fluid outlet means and having an outlet connected to the fluid inlet conduit for the second set of pumping chambers, means subjecting said selector valve to pressure in the fluid inlet means for opening the selector valve to connect the fluid outlet means with the selector valve outlet, and means for closing the check valve when the selector valve opens.

5. A system as defined in claim 4 wherein said means for closing the check valve includes an orifice passage in the check valve communicating with said selector valve outlet.

* * * * *